United States Patent [19]

Tomsa

[11] Patent Number: 4,542,952

[45] Date of Patent: Sep. 24, 1985

[54] ELECTRICAL CONNECTOR ASSEMBLY HAVING LOCKING MEANS

[75] Inventor: Vladimir Tomsa, Chicago, Ill.

[73] Assignee: Allied Corporation, Morris Township, Morris County, N.J.

[21] Appl. No.: 604,796

[22] Filed: Apr. 27, 1984

[51] Int. Cl.[4] ..... H01R 13/625

[52] U.S. Cl. ..... 339/90 R; 339/DIG. 2

[58] Field of Search ..... 339/89 R, 89 C, 89 M, 339/90 R, 90 C, 113 R, DIG. 2; 285/82, 86, 89

[56] References Cited

U.S. PATENT DOCUMENTS

| | | | |
|---|---|---|---|
| 1,871,421 | 8/1932 | Muhlhauser | 285/82 |
| 3,351,886 | 11/1967 | Zimmerman, Jr. | 339/90 |
| 3,455,580 | 7/1969 | Howard | 339/90 |
| 3,594,700 | 7/1971 | Nava et al. | 339/89 |
| 3,601,764 | 8/1971 | Cameron | 339/89 |
| 3,665,371 | 5/1972 | Cripps | 339/90 C |
| 3,808,580 | 4/1974 | Johnson | 339/89 R |
| 3,840,839 | 10/1974 | Smaczny et al. | 339/49 |
| 3,901,574 | 8/1975 | Paullus et al. | 339/90 |
| 3,917,373 | 11/1975 | Peterson | 339/89 |
| 3,947,081 | 3/1976 | Peterson | 339/90 |
| 3,971,614 | 7/1976 | Paoli et al. | 339/89 R |
| 4,007,953 | 2/1977 | Powell | 285/321 |
| 4,023,881 | 5/1977 | Migneau | 389/90 R |
| 4,059,324 | 11/1977 | Snyder et al. | 339/89 |
| 4,165,910 | 8/1979 | Anderson | 339/89 M |
| 4,204,740 | 5/1980 | Krolak | 339/90 R |
| 4,235,498 | 11/1980 | Snyder | 339/90 |
| 4,239,315 | 12/1980 | Lacaza, Jr. | 339/89 |
| 4,290,662 | 9/1981 | Storcel | 339/89 M |
| 4,305,180 | 12/1981 | Schwartz | 339/90 |
| 4,359,256 | 11/1982 | Gallusser et al. | 339/90 R |
| 4,464,001 | 8/1984 | Collins | 339/DIG. 2 |

*Primary Examiner*—John McQuade

*Attorney, Agent, or Firm*—C. D. Lacina

[57] ABSTRACT

A spring member (40) comprising a plate (42) and a U-shaped leaf portion (44) is carried on the inner wall of a coupling nut (30), the leaf portion including a deflectable leaf portion (45) including a detent (46) and a foot portion (43), the wall having a helical groove (36) for captivating a pin (18) extending from a receptacle shell (12) and an annular rib (60) for seating the spring member adjacent the terminus (35) of the groove, the receptacle being drawn into metal-to-metal contact with a plug shell (20) by coupling rotation of the coupling nut whereupon the detent captivates the pin and locks the coupling nut from uncoupling rotation relative to the plug shell.

11 Claims, 5 Drawing Figures

ELECTRICAL CONNECTOR ASSEMBLY HAVING LOCKING MEANS

This invention relates to an electrical connector assembly having locking means.

An electrical connector assembly includes a rotatably mounted coupling member to assemble and retain plug and receptacle connector members together in mated relation and a locking arrangement operative with the coupling member to prevent unwanted separation of the connector members after mating has been achieved. One locking arrangement comprises a bayonet connection wherein a force generated by a compressed wave washer causes bayonet pins from the receptacle to work against grooves on the coupling member and to seat in a detent disposed at the end of the groove, the biased seating preventing unwanted rotation of the coupling member and indicating that a fully mated condition has been reached. In some applications wherein RFI/EMI shielding is a consideration, metal-to-metal contact between the mated connector members is absolutely essential for proper operation of the connector. Because of the cooperation of the wave washer and action of the bayonet pin against the groove, excessive wear is known to occur. Such wear could cause the detents to become shallow and compromise metal-to-metal contact.

In U.S. Pat. Nos. 3,455,580, "Locking Device In A Bayonet Electrical Connector" issuing July 15, 1969 to Howard, a one-piece C-ring includes three "U-shaped" bumps for positioning the C-ring against an end wall of the coupling nut and three "V-shaped" risers spaced 120° apart for opposing the reverse movement of the bayonet pins. Such a C-ring may be undesirable because the 120° spacing of the risers may not be accurately maintained. The bayonet pin works against the sidewall of a bayonet groove adjacent to the riser and must deflect the riser to be captivated. However, the axial separation of the side wall relative to the end wall varies. After each bayonet pin overcomes the apex of its riser, the C-ring and thus the risers may become distorted whereupon the risers cam the pin against the sidewall so that the forward axial advance of the bayonet pin does result in the plug and receptacle connector members mating in metal-to-metal contact. Accordingly, to assure such metal-to-metal contact it would be desirable to provide a bayonet pin arrangement which is securely locked into a detent.

In U.S. Pat. No. 4,235,498, "Electrical Connector With Locking Means", issuing Nov. 25, 1982 to Snyder, a locking ring includes a row of detents defined by a succession of peaks and valleys, each detent being adapted to captivate a bayonet pin driven thereacross. The user, in some applications, may not know if the last detent—indicative of metal-to-metal contact was reached. While such a design has been suitable for the purposes intended, a single detent would provide a single audible click to indicate full mate and may be more desirable by the user in the field.

A general object of this invention is to provide improved locking means for preventing unwanted rotation of a coupling member relative to mated electrical connector members and maintaining metal-to-metal contact between the connector members when mated.

A separable electrical connector assembly comprises mating plug and receptacle connector members, a coupling member rotatably mounted to the plug and having a helical groove adapted to engage with a bayonet pin extending from the receptacle to draw the plug and receptacle connector members together into mated relation wherein the connector members are in metal-to-metal contact, and locking means for preventing unwanted rotation of the coupling member and maintaining metal-to-metal contact after the connector members are in mated relation.

The locking means is characterized by a spring member disposed at the terminus of the helical groove for captivating the bayonet pin when the pin is rotated thereto, the spring member comprising a plate for mounting the spring member to the coupling member and a resilient element provided with a detent for captivating the bayonet pin when the coupling member has advanced the connector members to the predetermined metal contacting position. The resilient element intercepts the helical groove and comprises an elongated leaf member formed into a U-shaped section which extends perpendicularly from the plate with the leaf member having one end of the "U" secured to the plate and the other end of the "U" cantilevered therefrom and disposed in the groove to be deflected rearwardly upon engagement with the bayonet pin whereupon the detent captivates the pin to prevent unwanted uncoupling rotation of the coupling member.

Further, an annular rib is disposed around the interior wall of the coupling member, the rib including a gap which intersects the terminus of the groove and receives the plate. The cantilevered other end of the leaf includes a resilient foot, the foot being adapted to abut the rib and bias the leaf with its detent forwardly to enhance the pin captivation.

An advantage of this invention is provision of a simple locking spring which does not induce wear on the pin captivating pocket of a bayonet groove which would then frustrate axial metal-to-metal engagement between the connector members, and which provides an audible "click" to indicate to a user that a positive metal-to-metal locked engagement between the connector members has been achieved.

A more complete understanding of this invention may be obtained from the detailed description which follows taken in conjunction with the accompanying drawings, in which.

Figure 1:
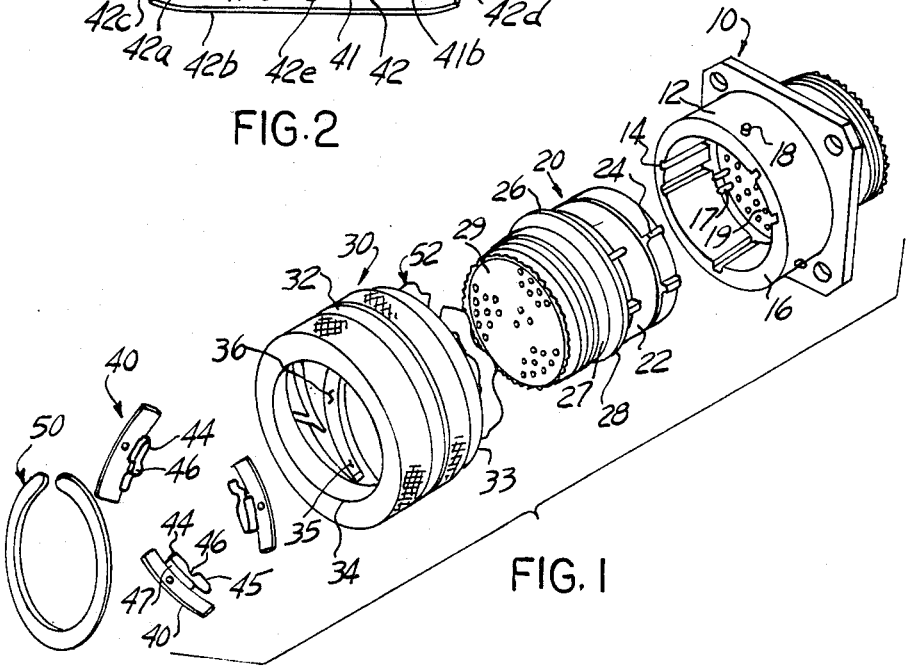
FIG. 1 is an exploded view of an electrical connector assembly.

Referring now to the drawings, FIG. 1 shows a separable electrical connector assembly comprising a pair of connector members adapted for a quick connection by a coupling nut utilizing a bayonet-type coupling arrangement for drawing the connector members together, the coupling arrangement releasably locking the connector members together in metal-to-metal engagement.

The connector assembly comprises a receptacle connector 10 having an axial keyway 14, a plug connector 20 having a key 24, a coupling nut 30 adapted to be rotatably carried about plug connector 20 for connecting with receptacle connector 10, a retaining ring 50 for captivating the coupling nut to the plug connector, a waved washer 52, and a spring member 40 for locking the connectors together, the key 24 being adapted to be received by the keyway 14 for orienting the plug connector relative to the receptacle connector and constraining the plug to be drawn axially into the receptacle upon rotation of coupling nut 30.

Receptacle connector 10 comprises a generally cylindrical metal shell 12 having an end face 16 and three radially extending bayonet pins 18, the pins being adjacent end face 16 and spaced equiangularly about the outer surface of shell 12. An insert 19 of dielectric material is mounted in the shell, the insert carrying a plurality of pin-type contacts 17 therein.

Plug connector 20 comprises a generally cylindrical metal shell 22 including an annular flange 28 and an annular recess 27 circumjacent to the flange, the flange 28 extending radially outward from shell 22 and having a forward face 26 which is adapted to abut end face 16 of the receptacle shell when the connectors are mated. An insert 29 of dielectric material is mounted in the plug, the insert 29 carrying a plurality of socket-type contacts (not shown) which are adapted to be connected separately with corresponding of the associated pin-type contacts. Of course, the contacts could be other than shown and described.

The coupling nut 30 comprises a cylindrical sleeve 32 having a front face 33 and a radial flange 34 extending radially inward from a rearward portion of the sleeve, the radial flange being adapted to clearance fit about annular recess 27 of the plug shell for rotation thereabout and cylindrical sleeve 32 being adapted to telescope about receptacle shell 12. Sleeve 32 includes three helical grooves 36 on its internal wall to connect with one of the respective bayonet pins 18, each groove opening on front face 33 and extending helically inward therefrom to an interior terminus 35. Rotation of coupling nut 30 in threading engagement of pin with groove draws plug 20 into receptacle 10 and sleeve 32 about receptacle shell 12 until forward face 26 of the plug is in metal-to-metal contact with end face 16 of the receptacle.

Three spring members 40 are adapted to be carried by the coupling nut, each spring member being configured so as to be seated at the terminus 35 of each bayonet groove and each including a resilient, U-shaped, leaf member 44 having a locking detent 46, the detent captivating its associated bayonet pin 18 received therein to prevent unwanted reverse rotation of the coupling nut.

Figure 2:
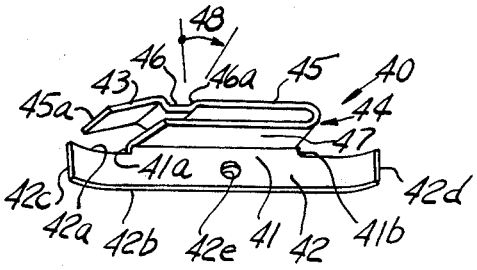
FIG. 2 is a spring member having a detent.

FIG. 2 shows spring member 40 as being one-piece and comprising a slightly arcuate base plate 42 having a tab 41 extending therefrom and the U-shaped leaf member 44 extending substantially perpendicularly to base plate 42 and tab 41. The leaf member folds an elongated leaf about and into a "U" section to describe spaced upper and lower leaf portions 45, 47, the lower leaf portion 47 rigidly interconnecting leaf member 44 to base plate 42 and the upper leaf portion 45 defining a cantilever-type beam having a deflectable end **45*a* and including the detent 46, the upper leaf portion being resiliently yieldable towards the lower leaf portion and terminating in a foot portion 43 inclined at an acute angle thereto downwardly therefrom towards lower leaf portion 47. Base plate 42 conforms to the inner wall of the coupling nut and has top and bottom edges 42*a*, 42*b*, lateral edges 42*c*, 42*d*, an aperture 42*e* sized to receive a pin or a rivet to secure the plate to the coupling nut, and the tab 41, the tab having lateral end faces 41*a*, 41*b* and securing the lower leaf portion 47 to the top edge of the plate. The tab and the plate, in combination, cooperate to define a pair of notches and a pair of laterally extending plate portions for seating the spring member in a gap on the coupling nut. (See FIG. 3.) Detent 46 includes a flank 46*a* for abutting pin 18, the flank being disposed at an acute angle relative to a vertical line from upper leaf portion 45 and shown by 48. As acute angle 48 approaches zero degrees (i.e., flank 46*a* is perpendicular to the leaf portion) the greater is the resistance to uncoupling rotation. Conversely, as acute angle 48 approaches 90° (i.e., flank 46*a* is level with the leaf portion) the more likely that rotation may be permitted. Preferably, acute angle 48** would be in the range of between 20°–40°.

Figure 3:
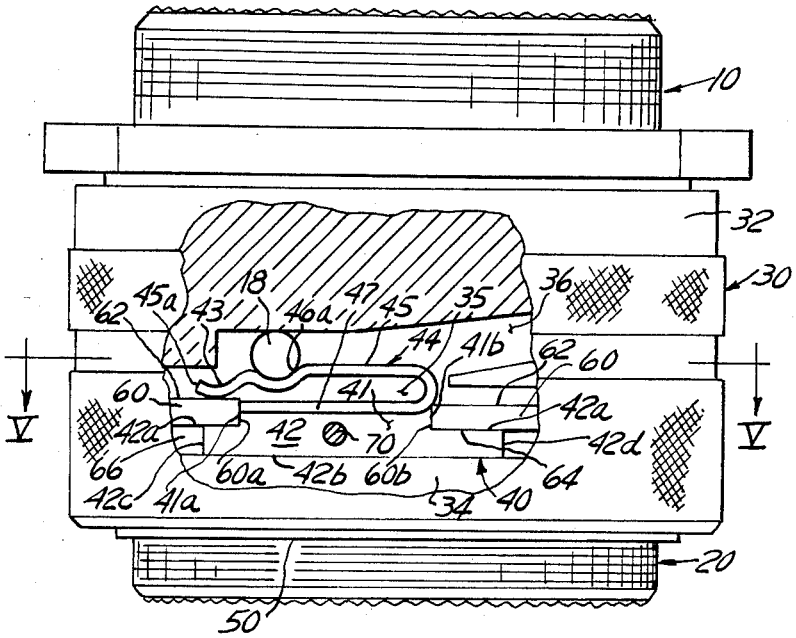
FIG. 3 is the electrical connector assembly of FIG. 1 when mated with portions thereof being cut-away and partially in section.

FIG. 3 shows plug 20, receptacle 10 and coupling nut 30 in mated relation, and pin 18 from receptacle shell 12 captivated in detent 46.

The inner wall of coupling sleeve 32 is provided with an annular rib 60 axially forward of radial flange 34, the annular rib having a forward wall 62 which is facing terminus 35 of the helical groove 36 and a rearward wall 64 which is facing annular flange 28, an annular groove 66 being defined between the annular rib 60 and radial flange 34. Annular rib 60 includes an arcuate gap defined by angularly spaced sidewalls **60*a*, 60*b***.

Spring member 40 is mounted to the inner wall of coupling sleeve 32 such that U-shaped leaf member 44 and tab 41 seat between the arcuate gap with end faces **41*a*, 41*b* abutting the respective spaced sidewalls 60*a*, 60*b*, the plate has its plate portions 42 extending laterally and seating in annular groove 66 with top and bottom edges 42*a*, 42*b* thereof abutting, respectively, the rearward wall 64 of annular rib 60 and radial flange 34, the pin 18 being captivated in detent 46 and abutted against flank 46*a*, and the foot portion 43 of upper leaf portion 45 biased against the forward wall 62 of annular rib 60. A pin 70 passes through aperture 42*e* to rigidly secure spring member 40 to coupling nut 30**.

Figure 4:
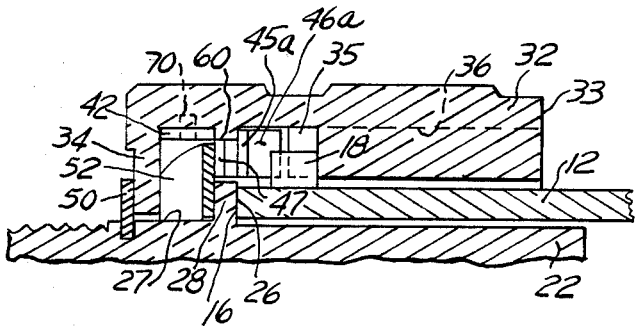
FIG. 4 is a partial side view, in section, of the mated electrical connector assembly.

FIG. 4 shows a side view of the mated relation between plug and receptacle shells 12, 22 wherein the forward face 26 of the plug is disposed in metal-to-metal contact with end face 16 of the receptacle. Spring member 40, carried on coupling sleeve 32, is disposed in annular groove 66 formed between radial flange 34 and rib 60. Bayonet pin 18 is captivated by detent 46.

Figure 5:
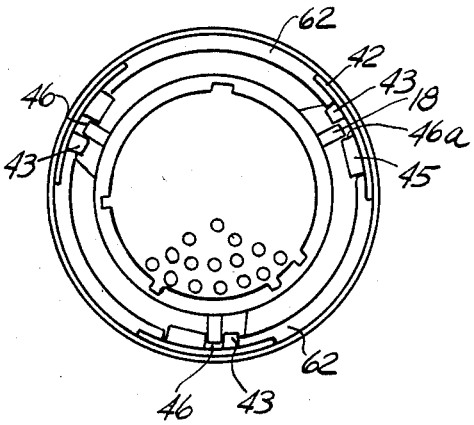
FIG. 5 is a cross-section view of the mated electrical connector assembly taken along lines V—V of FIG. 3.

FIG. 5 shows a cross-section of the mated connector assembly with three bayonet pins 18 being captivated within the respective detents 46 in each of three equiangularly disposed spring members 40. A set of three like arcuate gaps are disposed in annular rib 60, each gap being defined by angularly spaced sidewalls **60*a*, 60*b* and each registered with the terminus of one helical groove 36**.

When the "U-shaped" spring member 40 is mounted to the coupling nut 30 and when pin 18 is not present in the detent area, foot portion 43 is not abutting against forward wall 62 of annular rib 60. During coupling, incoming bayonet pin 18 deflects upper leaf portion 45 as a cantilever-type spring and foot portion 43 deflected into abutment against forward wall 62. The initial force developed as pin 18 is driven over leaf portion 45 is low continued rotation of pin 18 deflects leaf portion 45 as a simple beam (having opposite ends supported) and develops significant force and assists in resisting retrograde rotation of pin 18 from detent 46.

We claim:

1. An electrical connector assembly comprising first and second connector members, a coupling member rotatably carried by said first connector member, one and the other said second connector member and said coupling member being provided with a radially extending bayonet pin and a wall including a helical groove arranged to be threadably engaged by the pin for pulling the connector members together upon rotation of the coupling member in one direction, and locking means for preventing unwanted rotation of said coupling member in the other direction, said locking means being characterized by: a spring member disposed at the terminus of said helical groove for captivating said bayonet pin when the pin is advanced thereto, and a rib including a pair of angularly spaced sidewalls which define a gap extending from said wall including the helical groove, said spring member comprising a plate having lateral end faces abutted against respective of said sidewalls and mounted to the wall and a resilient leaf member having first and second end portions, said first end portion being secured to said plate and said second end portion being free to deflect and including a detent for captivating said pin, advancement of said pin to said leaf member deflecting said second end portion and advancing said pin into captivated relation with said detent.

2. The invention as recited in claim 1 wherein said first end portion of the leaf member is disposed between the sidewalls.

3. The invention as recited in claim 1 wherein said spring member is one-piece and comprises said first and second end portions being disposed in overlapping relation to form a generally U-shaped section, each said end portion being planar and disposed in a plane extending generally perpendicularly to a plane including the plate.

4. The invention as recited in claim 1 wherein said coupling member includes a radial flange and a coupling sleeve, said helical groove and rib are disposed on the inner wall of said coupling sleeve, and said plate includes a tab which interconnects said first end portion to said plate, said rib being axially spaced from the radial flange to define an annular groove therebetween, and the plate having plate portions extending laterally of the tab and seating in the annular groove.

5. The invention as recited in claim 1 wherein said one and the other of said second connector member and said coupling member are provided with three said radially extending bayonet pins and helical grooves with each said pin and said helical groove being spaced equiangularly, said rib extending annularly and includes three equiangularly disposed gaps, and a spring member is disposed in each of said gaps.

6. The invention as recited in claim 1 wherein a resilient foot portion is disposed at an acute angle to the plane of said second end portion, said foot portion extending from said detent and being abuttable against the forward wall of said rib to bias the second end portion and detent forwardly upon activating the pin within the detent.

7. The invention as recited in claim 1 wherein said detent includes a flank disposed at an acute angle relative to an imaginary line generally perpendicular to the plane including the second end portion of said leaf member.

8. The invention as recited in claim 7 wherein said acute angle is in the range of 20°–40°.

9. The invention as recited in claim 1 including means for securing the spring member to said member including said helical groove.

10. The invention as recited in claim 9 wherein said securing means is a pin driven through an aperture in said plate.

11. A coupling member for use with an electrical connector of the type comprising a first cylindrical shell adapted to mate with a second cylindrical shell, said coupling member being adapted to be rotatably mounted to said first shell and including a helical groove on its inner wall to engage a bayonet pin extending radially outward from said second shell, said coupling member being characterized by an annular rib extending from its inner wall and including an arcuate gap, and a locking spring being disposed adjacent to the terminus of said helical groove, said locking spring comprising an arcuate plate seated in the arcuate gap formed in the annular rib and a U-shaped leaf member comprising a pair of interconnected leaf portions, one of said leaf portions extending from said plate and the other of said leaf portions extending from the one of said leaf portions and including a detent for captivating the bayonet pin.

* * * * *